US012201228B2

(12) United States Patent
Morrish et al.

(10) Patent No.: US 12,201,228 B2
(45) Date of Patent: Jan. 21, 2025

(54) PICTURE FRAME

(71) Applicants: Edward Glen Morrish, Powys (GB); John Morrish, Powys (GB); Mark Peter Morrish, Powys (GB)

(72) Inventors: Edward Glen Morrish, Powys (GB); John Morrish, Powys (GB); Mark Peter Morrish, Powys (GB)

( * ) Notice: Subject to any disclaimer, the term of this patent is extended or adjusted under 35 U.S.C. 154(b) by 233 days.

(21) Appl. No.: 17/889,770

(22) Filed: Aug. 17, 2022

(65) Prior Publication Data

US 2023/0057764 A1 Feb. 23, 2023

(30) Foreign Application Priority Data

Aug. 17, 2021 (GB) ..... 2111798

(51) Int. Cl.
*A47G 1/06* (2006.01)

(52) U.S. Cl.
CPC .... *A47G 1/0611* (2013.01); *A47G 2001/0666* (2013.01)

(58) Field of Classification Search
CPC ..... A47G 1/0611; A47G 2001/0666; A47G 1/0633
See application file for complete search history.

(56) References Cited

U.S. PATENT DOCUMENTS 1,331,009 A * 2/1920 Ford ..... A47G 1/0633 40/788
4,870,766 A 10/1989 Topping
5,513,455 A * 5/1996 Walker ..... G09F 1/06 40/788
9,358,830 B1 * 6/2016 McLaughlin ..... B44D 3/18
2013/0227868 A1 * 9/2013 Edmondson ..... A47G 1/0633 40/743
2014/0314971 A1 * 10/2014 Domanski ..... B41M 5/508 428/32.18

(Continued)

FOREIGN PATENT DOCUMENTS

GB 0965390 A 7/1964
GB 2461863 A 1/2010

OTHER PUBLICATIONS

British Office Action for Application No. GB2111798.1 dated Jan. 21, 2022, pp. 1-3.

(Continued)

*Primary Examiner* — Gary C Hoge
(74) *Attorney, Agent, or Firm* — Lerner David LLP

(57) ABSTRACT

A picture frame comprising a picture carrier portion and a frame portion, the picture carrier portion to carry a picture member; the frame portion comprising frame members with: an outer side member hingedly connected at a first hinge connection to the picture carrier portion; a back member hingedly connected at a second hinge connection to the outer side member, and an inner side member hingedly connected at a third hinge connection to the back member, wherein in an assembled position: the outer side member forms an outer side of the frame, the back member forms a back of the frame, and; the inner side member forms an inner side of the frame, wherein a connection system is arranged to lock the inner side member to the picture carrier portion.

20 Claims, 7 Drawing Sheets

(56) References Cited

U.S. PATENT DOCUMENTS

| | | | | |
|---|---|---|---|---|
| 2016/0073797 | A1* | 3/2016 | Morrish | B31F 1/0016 156/216 |
| 2016/0143461 | A1* | 5/2016 | Millman | A47G 1/0633 156/226 |
| 2017/0172325 | A1 | 6/2017 | Greene | |
| 2017/0311738 | A1 | 11/2017 | Wong | |
| 2018/0213950 | A1* | 8/2018 | Millman | A47G 1/14 |
| 2019/0210403 | A1* | 7/2019 | Fernandez Munizaga | A47G 1/0633 |
| 2019/0246817 | A1* | 8/2019 | Lam | A47G 1/0633 |
| 2019/0261789 | A1* | 8/2019 | Millman | A47G 1/06 |
| 2020/0229620 | A1* | 7/2020 | Mateer | A47G 1/1633 |
| 2021/0219748 | A1* | 7/2021 | Marcinów | A47G 1/10 |

OTHER PUBLICATIONS

Communication from the UK Intellectual Property Office dated Aug. 5, 2022, 1 Page.

* cited by examiner

PICTURE FRAME

CROSS-REFERENCE TO RELATED APPLICATION

The present application claims priority from Great Britain Patent Application No. 2111798.1 filed on Aug. 17, 2021, the disclosure of which is hereby incorporated by reference.

TECHNICAL FIELD

The present disclosure relates to a picture frame to frame a picture.

BACKGROUND

Picture frames provide a protective edging for a picture, which can include a painting or photograph. The picture frame can be configured to attach to a wall and/or to stand up on a surface. It is becoming increasingly popular to display pictures with picture frames, particularly as users of mobile phones are frequently taking pictures with such devices.

A conventional picture frame is made of wood or metal. These frames can be expensive to produce due to the quantity and expense of the materials required. They may also be time consuming to fit to a picture, for example, the picture may have to be cut to a particular size and/or mounted to a carrier, which is then clamped to the frame. Conventional picture frames are therefore not suitable for mass production.

Therefore, in spite of the effort already invested in the development of said picture frames further improvements are desirable. In particular, it is desirable to provide a cost effective picture frame that is suitable for mass production.

SUMMARY

The present disclosure provides a picture frame to support a picture member. The picture frame comprises a frame portion and a picture carrier portion, which in an assembled configuration connect together to support a picture member. The picture carrier portion carries the picture member, e.g. so that a central front face with the main picture element on is displayed. In embodiments, the frame portion comprises frame members that are connected to the picture carrier portion at hinge connections.

[Three Member Frame Portion]

In embodiments, the frame members comprise: an outer side member hingedly connected at a first hinge connection to the picture carrier portion; a back member hingedly connected at a second hinge connection to the outer side member, and; an inner side member hingedly connected at a third hinge connection to the back member.

In an assembled position: the outer side member forms an outer side of the frame, the back member forms a back of the frame, and; the inner side member forms an inner side of the frame.

By implementing three frame members in this manner the picture frame may have an aesthetic appearance of a more expensive/complex to assemble conventional wooden frame, particularly when viewed from the back. This may permit the picture frame to more be more favourably used when stood on a table where it is viewable from the back as well as on a wall where the back is not visible.

Moreover, by implementing three frame members, the picture member may be connected to the third member, such that it experiences hinging as it is wrapped around three hinged connections and therefore a high level of tension when assembled. A high level of tension may provide a better quality of visual display for the picture.

As used herein the term "form a side or back of the frame" in respect of the inner side member, outer side member and back member, may refer to forming a substantial structural component of said side or back, another component including the picture member may be disposed over said side or back member such that it is not exposed.

In embodiments, a connection system is arranged to connect the inner side member to the picture carrier portion. The connection may be directly between the inner side member and the picture carrier member. In embodiments, no other connection systems between the frame members and the other frame members and the picture carrier portion may be present.

By connecting the inner side member to the picture carrier portion a rigid frame structure may be provided that has an appearance of a conventional picture frame.

The connecting may be a locking connection. As used herein the term "lock" may refer to an arrangement to secure the inner side member to the carrier portion in a latching manner that precludes disconnection by pulling in an opposed direction to a locking direction, e.g. not an interference fit. A locking connection may include: a hook and loop connection; a ratchet connection; a catch and latch, and; other like connection. A locking connection may prevent unsightly disconnection of the assembly with time.

In embodiments, the connection system includes a first engagement member arranged on the inner side member and a complimentary second engagement member arranged on the picture carrier portion. In embodiments, the first engagement member includes one of a hook shaped extension or a complimentary aperture, and the second engagement member includes the other of a hook shaped extension or a complimentary aperture.

In embodiments, the second engagement member is arranged on an extension portion that extends from a body of the picture carrier portion. By arranging the second engagement member on an extension portion that extends in the depth direction, the extension portion may overlap the inner side member and provide a convenient support for the second engagement member. It may also provide additional rigidity to the picture carrier portion.

As used here in the term "extend in the depth direction" may refer to any direction aligned to the depth direction and can therefore include an extension in the depth direction or an extension in the counter depth direction.

In embodiments, a second engagement system is operatively associated with at least one of the hinge connections, the second engagement system engaged to define a terminal hinge position, in which the adjoining frame members or an adjoining frame member and picture carrier portion are perpendicular (including substantially perpendicular, e.g. plus or minus 5 or 10 degrees from 90 degrees) to each other, wherein the second engagement system is arranged distal (e.g. so it is not part of or connected to a component of the hinge connection) said hinge connection.

By implementing a second engagement system distal from the hinge pressure on the hinge and/or a first engagement system of the hinge may be reduced. The second engagement system may give the feel of a solid frame structure when a user squeezes the frame members.

In embodiments, a third engagement system is arranged with a first engagement member on the back member to engage with a second engagement member on the picture carrier portion to maintain (including substantially maintain from the terminal hinge position, e.g. plus or minus 5 or 10 degrees) the outer side member in the terminal hinge position defined by the first engagement system and/or the second engagement system.

By implementing both a second engagement system and a third engagement system the outer side member may be stabilised e.g. in both positive and negative lateral/longitudinal directions, to give the frame structure a solid feel.

In embodiments, the third engagement system is arranged with the second engagement member on an extension portion that extends from a body of the picture carrier portion.

By arranging the second engagement member on an extension portion that extends in the depth direction, the back member may overlap the extension portion, which provides a convenient support for the second engagement member. The extension portion may also provide additional rigidity to the picture carrier portion.

In embodiments, the extension portion extends in a lateral or longitudinal direction outwardly towards the outer side member from a portion comprising the second engagement member of the connection system to accommodate the second engagement member of the third engagement system.

By arranging the extension portion to splay outwards from the connection system to the third engagement system, the same extension portion may conveniently incorporate both components whilst enhancing structural rigidity.

In embodiments, in the assembled position, a rim of the inner side member engages a back surface of a body of the picture carrier portion. By arranging the end of the inner side member to abut the picture carrier portion, the feel of a solid frame structure may be provided.

In embodiments, in the unassembled position, the frame members are arranged in a longitudinal and lateral plane of the picture carrier portion with the inner side member having an outer surface to receive a picture member.

By arranging the picture frame to be arrangeable substantially flat in the unassembled position, it may be more compactly stored/transported pre-assembly. Moreover, the picture member may be connected to the inner side member in this position such that as it is folded three times at the three hinge connections with a high level of tension applied thereto, and hence quality of finish may be provided.

In embodiments, the inner side member includes reduced thickness portions to aid insertion of a fixing member therethrough to fix the picture member to the inner side member. Having thinner sections may provide easier insertion of the fixing member, they may also help to guide a user to insert the fixing members in a particular position that is most effective.

[Hinge Connection]

In embodiments, the frame members in and assembled position form a frame structure, wherein one or more of said hinged connections is arranged with a cut-out portion that in an unassembled position, in which the frame members are arranged in a lateral and longitudinal plane of the picture carrier portion, includes a flat base to define a hinge member, and in the assembled position the hinge member curves around a hinge axis.

By implementing a hinge connection with a hinge member that has a cut-out with a flat bottomed base, rather than a V-shaped or other like shaped groove, the hinge member can curve around the hinge axis as opposed to folding at a point defined by the V-shape (or other shape). Such an arrangement may permit the formation of the picture frame from a harder material since the hinge member is less likely to fracture because is subject to a more distributed curvature rather than a point curvature. This reduced restriction of material means that an overall stiffness of the picture frame can be improved by the use of a stiffer material.

As used herein the term "cut-out" may refer to a portion of material of reduced cross-section, however said reduced section does not require formation by removal of material (although this one possible means for its formation).

In embodiments, the hinge member is formed integrally with the adjoining frame members and/or a frame member and picture carrier portion. With a picture frame formed of a single piece of material the picture frame may be cost effective.

In embodiments, a thickness of the hinge member is less than 20% or 10% of a thickness of the adjoining frame members and/or an adjoining frame member and picture carrier portion. By implementing a comparatively thin hinge member it may have enhanced flexibility to enable it to curve around a hinge axis without fracturing.

In embodiments, at least one of the hinge connections comprises a first engagement system that is engaged to define a terminal hinge position, in which the adjoining frame members or an adjoining frame member and picture carrier portion are perpendicular (including substantially perpendicular, e.g. plus or minus 5 or 10 degrees from 90 degrees) to each other.

By implementing a first engagement system that is arranged as part of the hinge connection, over rotation of the hinge may be precisely avoided which could otherwise cause fracture of the hinge member.

In embodiments, the first engagement system is arranged as one or more extensions that extend outwardly from adjoining frame members or an adjoining frame member and picture carrier portion. The extensions may be perpendicular to each other in the terminal hinge position.

In embodiments, the first engagement system is arranged on either side of the cut-out portion.

In embodiments, in the assembled position the first engagement system and cut-out define a void, which is bounded at one end by the hinge member and at another end by the first engagement system. The void may provide a region that the frame member can curve unto uninhibited, which may avoid stress concentrations and therefore fracture.

In embodiments, the picture carrier portion and frame portion are integrally formed. In embodiments a material of formation is plastic based.

In embodiments a material of formation comprises compounds that are styrene based, including: High Impact Polystyrene (HIPS); Medium Impact Polystyrene (MIPS); ABS. Other materials may be used such as Acrylic. Comparatively softer materials, including Polypropylene are unlikely to be used since that do not provide the desired stiffness.

In embodiments a material of formation comprises a Youngs modulus of greater than 1500 MPa or 1800 MPa or 2000 MPa, e.g. 2000-3000 MPa.

[Stand Connection]

The present disclosure provides the picture frame of any preceding embodiments or another embodiment disclosed herein and a corresponding stand portion. An engagement system comprises an aperture in the picture frame to receive a head of the stand portion. The head insertable in to the aperture in an open position and rotatable to a locked position where it is not extractable (without further rotation) from the aperture. In embodiments the head includes an extension key that corresponds in shape to the aperture and can project through the aperture in the open position and which abuts against an wall proximal the aperture in the locked position.

[System]

The present disclosure provides a picture frame of the preceding embodiments or another embodiment disclosed herein and a corresponding picture member.

In embodiments, the picture frame is arranged in an assembled position, with fixing a member (e.g. a staple) fixing the picture member to the inner side member.

[Use]

The present disclosure provides use of the picture frame of any preceding embodiment or another embodiment disclosed herein for mounting a picture.

The present disclosure provides use of the picture member of any preceding embodiment, or another embodiment disclosed herein, for the picture frame any preceding embodiment, or another embodiment disclosed herein.

[Method]

The present disclosure provides a method of mounting a picture to a frame.

In embodiments, the method comprises, with a frame portion comprising frame members with: an outer side member hingedly connected at a first hinge connection to a picture carrier portion; a back member hingedly connected at a second hinge connection to the outer side member, and; an inner side member hingedly connected at a third hinge connection to the back member, connecting a picture member to the frame portion; hinging the hinge connections to connect the inner side member to the picture carrier member.

In embodiments, the method comprises locking the inner side member to the picture carrier member.

In embodiments, the method comprises connecting the picture member to the frame portion prior to hinging said hinge connections. In embodiments, the method comprises connecting the picture member to the inner side member prior to hinging said hinge connections.

In embodiments, the method comprises hinging about a hinge axis a hinge member of a hinged connection of a frame portion that is connected to a picture carrier portion, wherein the hinged connection includes a cut-out portion with a flat base to define said hinge member.

The preceding summary is provided for purposes of summarizing some embodiments to provide a basic understanding of aspects of the subject matter described herein. Accordingly, the above-described features are merely examples and should not be construed to narrow the scope or spirit of the subject matter described herein in any way. Moreover, the above and/or proceeding embodiments may be combined in any suitable combination to provide further embodiments. Other features, aspects, and advantages of the subject matter described herein will become apparent from the following Detailed Description, Figures, and Claims.

BRIEF DESCRIPTION OF THE FIGURES

Aspects, features and advantages of embodiments of the present disclosure will become apparent from the following description of embodiments in reference to the appended drawings in which like numerals denote like elements.

DETAILED DESCRIPTION OF EMBODIMENTS

Before describing several embodiments of the picture frame assembly, it is to be understood that the picture frame assembly is not limited to the details of construction or process steps set forth in the following description. It will be apparent to those skilled in the art having the benefit of the present disclosure that the system is capable of other embodiments and of being practiced or being carried out in various ways.

The present disclosure may be better understood in view of the following explanations:

As used herein the term "picture" or "picture member" may refer to an item comprising a picture article that is suitable for display with a picture frame, it can include: a photo; artwork that can include a painting; or other article. The picture article may comprise a picture face that presents the picture and a back face which is on an opposed face to the picture face. The picture member may include a carrier, e.g. a backing substrate, to support the picture article, which may be arranged behind the picture article when supported. The picture article and the carrier may be integrally formed, e.g. the picture article is printed onto the carrier. The picture member may be arranged to wrap around a frame portion of the picture frame or just to be connected to a picture carrier portion.

As used herein the term "picture frame" may refer to a support structure for the picture member The picture frame may be formed by any suitable technique for forming a structure from the relevant material. For a plastic based material it may be formed by one or more of: injection moulding; extrusion; machining from a solid material; other forming process. The picture frame may be arranged to support pictures of size of about 8×8 to 5×7 to 12×12 inches. The picture frame can include a frame portion and a picture carrier portion that can be separable or integrally formed.

As used herein the term "frame portion" may refer to a portion of the picture frame that implements a frame at the edges of the picture.

As used herein the term "picture carrier portion" may refer to a portion of the picture frame that presents a generally planar face to support a picture.

[General Components of Picture Frame and Picture Member]

Figure 1:
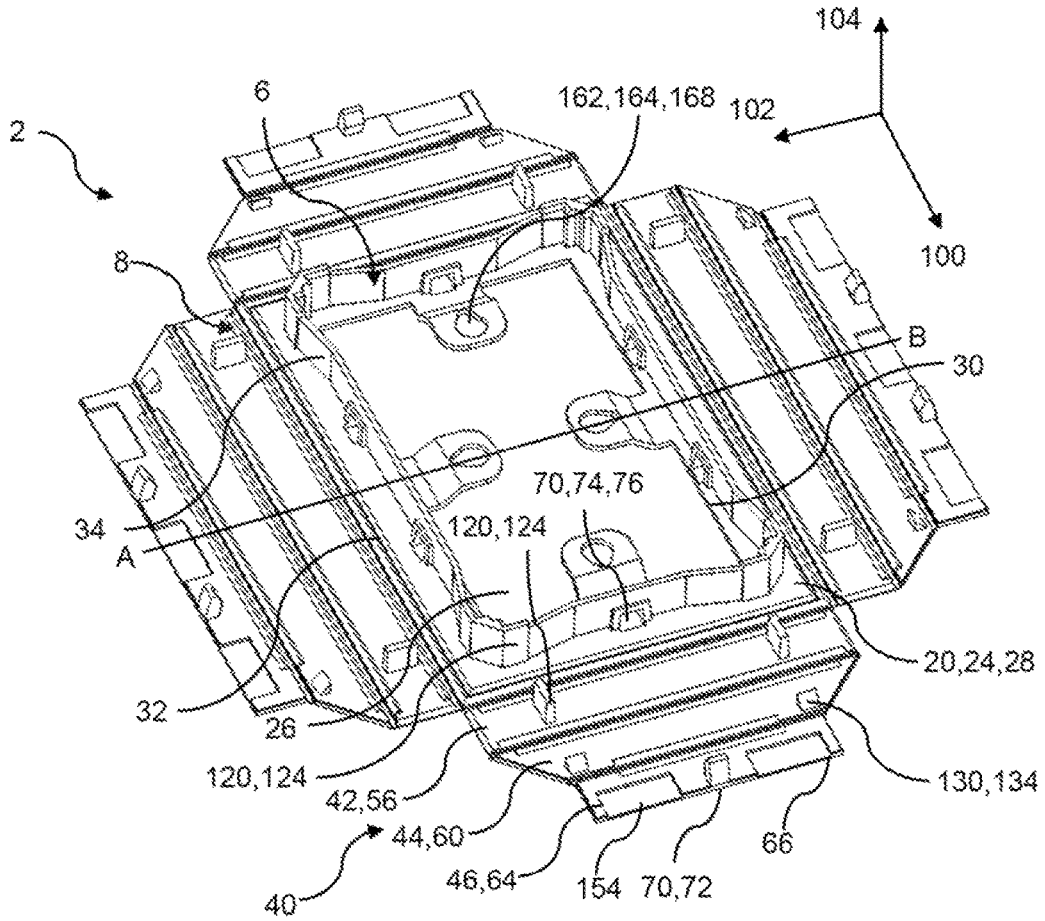
FIG. 1 is a to scale back perspective view showing an embodiment picture frame, which is arranged in an unassembled configuration.
Figure 2:
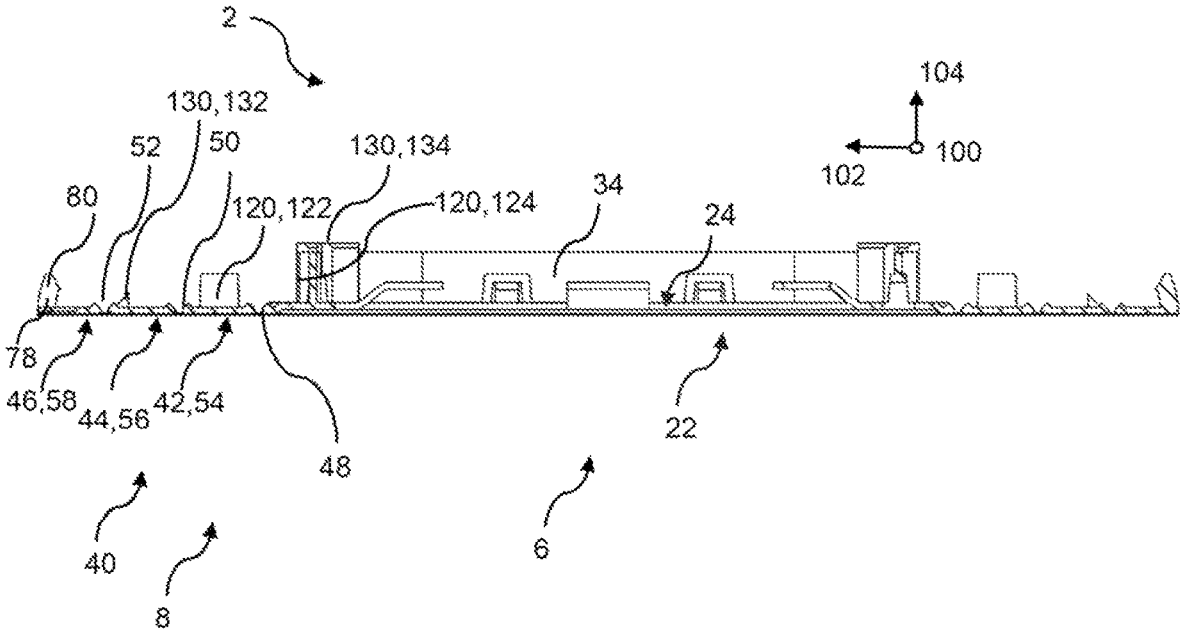
FIG. 2 is a side cross-section view through line AB of FIG. 1.
Figure 13:
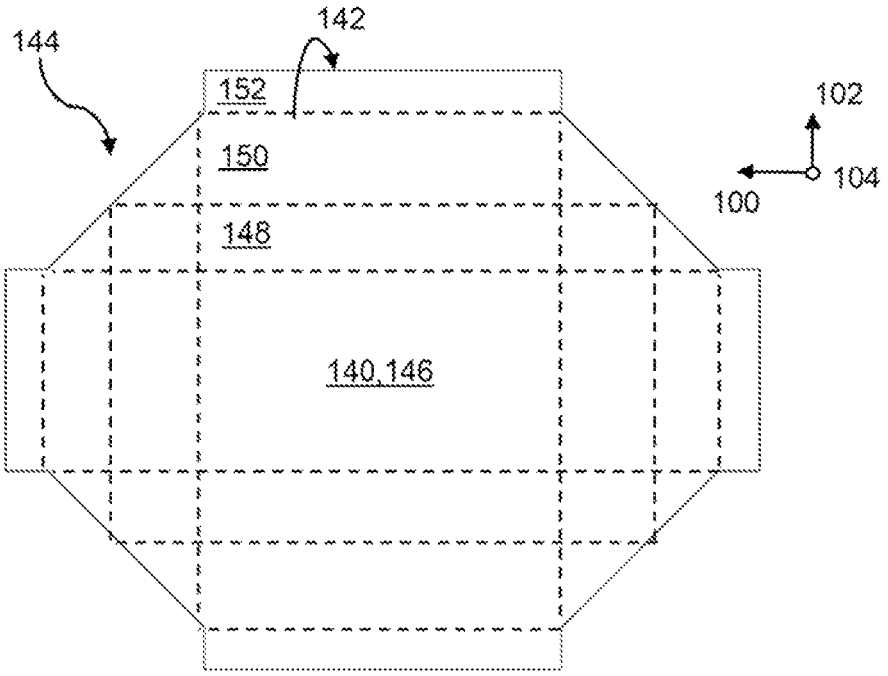
FIG. 13 is a perspective view of a picture member for the picture frame of FIG. 1.

Referring to FIGS. 1, 2, and 13 a picture frame 2 and picture member 4 in a disassembled configuration are illustrated. The picture frame 2 includes a picture carrier portion 6 and a frame portion 8. In the unassembled position shown in FIGS. 1 and 2, the picture carrier portion 6 and a frame portion 8 are aligned in an in-plane direction, which is defined by a longitudinal direction 100 and a lateral direction 102, which are both orthogonal to a depth direction 104.

Figure 9:
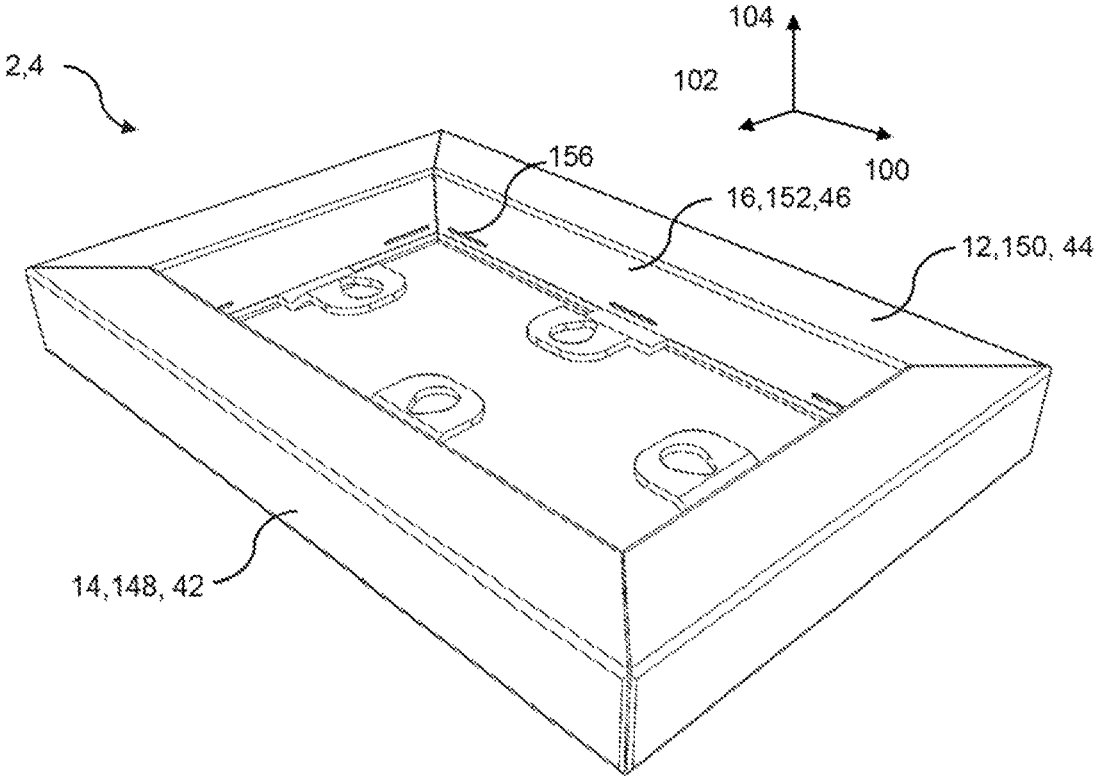
FIG. 9 is a back perspective view showing the picture frame of FIG. 1 with a picture member connected thereto, which is arranged in an assembled configuration.
Figure 10:
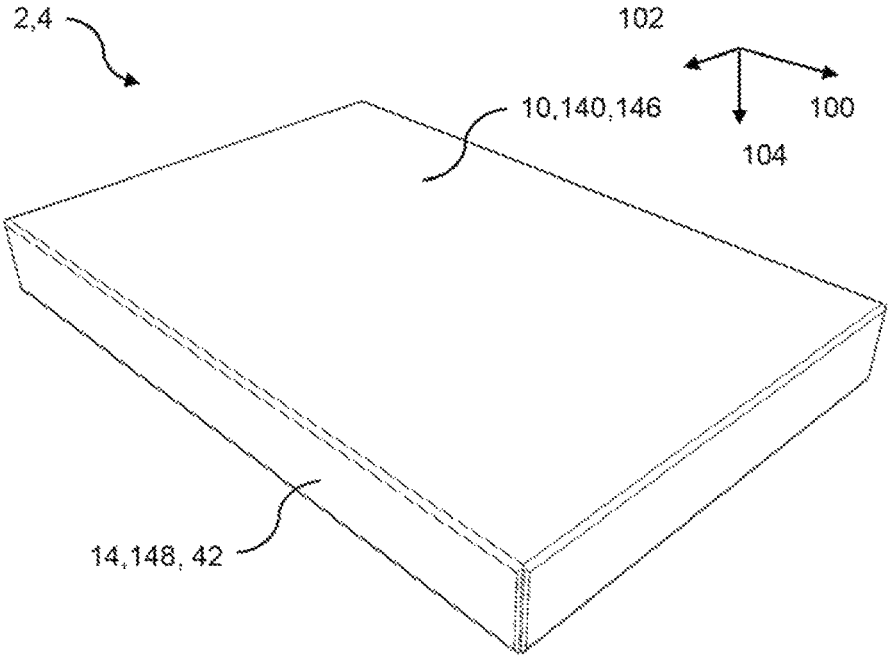
FIG. 10 is a front perspective view showing the picture frame an picture member of FIG. 9.

Referring to FIGS. 9 and 10 the picture frame 2 in an assembled configuration is illustrated, with a picture member 4 connected thereto. The assembled picture frame 2 and picture member 4 includes an exterior front face 10 a back face 12 an outer side face 14, and inner side face 16. Since the entire frame portion 8 is wrapped by the picture member 4, said exterior faces are presented by the picture member 4 as will be discussed.

In variant embodiments, which are not illustrated: rather than the picture member overlapping all three frame members, in may only overlap one or two.

[Picture Carrier Portion]

Referring to FIGS. 1 and 2, the picture carrier portion 6 includes a body 20 that has a front face 22 and a back face 24, both of which are aligned to a plane arranged in the longitudinal 102 and lateral 104 directions. The body 20 includes a rectangular shaped aperture 26 that is centrally aligned to define a flange 28. The flange 28 has an inner edge 30 that is defined by the aperture 26 and an outer edge 32 that defines the periphery of the body 20. The body 20 includes an extension portion 34 extends from the back face 24 in the depth direction 104. The extension portion 34 is arranged proximal the inner edge 30 of the peripheral rim 28.

The flange 28 is rectangular in shape, with the frame portion 8 arranged as four separate sections each attached to the one of the four outer edges 32.

Referring to FIG. 10, the front face 22 of the flange 28 of the body 20 includes a recess, such that a rear face of the picture member 4 is only in contact with a periphery of the front face 22.

In variant embodiments, which are not illustrated: the aperture is omitted or is a different shape; the extension portion is omitted and its associated components are located on the body, and; the picture carrier portion is alternatively shaped, including as rhomboid or triangular or hexagonal or other suitable shape (with a number of sets of frame member adapted to correspond to the numbers of sides of said shape).

[Frame Portion]

Referring to FIGS. 1 and 2, the frame portion 8 includes frame members 40. The frame members 40 are arranged as: an outer side member 42; a back member 44, and; an inner side member 46.

Although the following description for brevity refers to a single set of frame members 40, which extend in the longitudinal direction 100 and are for a left side of the frame 2, it will be appreciated that the description applies to all four, which comprise: left side longitudinal frame members; right side longitudinal frame members; top lateral frame members, and; bottom lateral frame members. Moreover, to preserve clarity in the figures, where appropriate corresponding features of other sets of frame members are numbered.

The outer side member 42 is connected to the outer edge 32 of the body 20 at a first hinge connection 48. The outer side member 42 is connected to the back member 44 at a second hinge connection 50. The inner side member 46 is connected to the back member 44 at a third hinge connection 52.

The outer side member 42 has a front face 54 and a back face 56. The back member 44 has a front face 58 and a back face 60. The inner side member 46 has a front face 62 and a back face 64.

Figure 7:
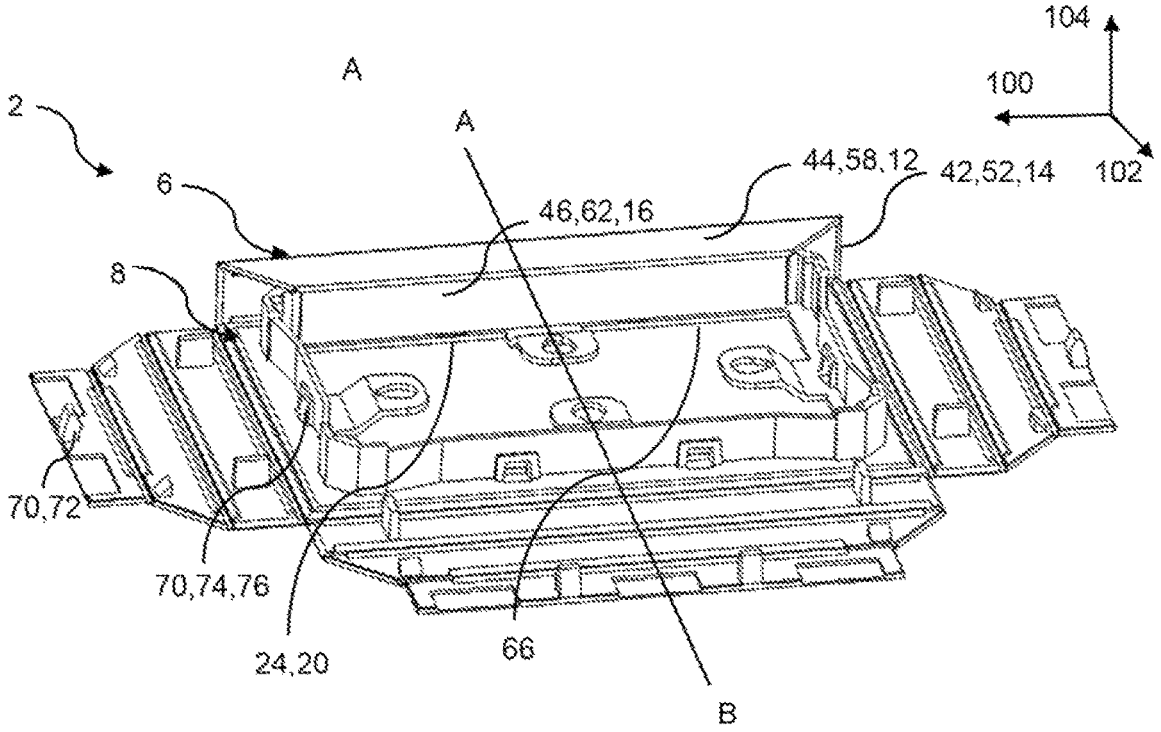
FIG. 7 is a back perspective view showing the picture frame of FIG. 1, which is arranged in a partially assembled configuration.
Figure 8:
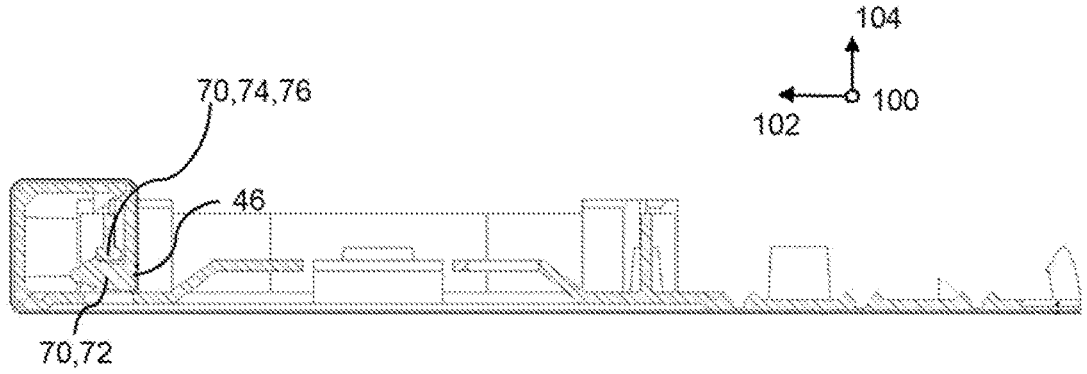
FIG. 8 is a side cross-section view through line AB of FIG. 7.

Referring to FIG. 7, with the left longitudinal frame members of the frame portion 8 in an assembled position in which adjoining frame members are at 90 degrees to each other: the front face 54 of the outer side member 42 forms the outer side face 14 of the frame 2; the front face 58 the back member 44 forms a back face 12 of the frame 2, and; the front face 62 the inner side member 46 forms an inner side face 16 of the frame 2. In the assembled position a tip 66 of the inner side member 46 engages the back face 24 of the body 20 of the picture carrier portion 6.

In variant embodiments, which are not illustrated: the frame members comprise only two or one members; the tip of the inner side member does not abut the body of the picture carrier portion, and; in the assembled position the frame members are arranged at other angles that 90 degrees to each other e.g. to give a tapered appearance.

[Connection System]

Referring to FIGS. 1, 2 and 7, 8, a connection system 70 is arranged to connect the inner side member 46 to the picture carrier portion 6.

The connection system 70 is configured as a locking connection, which includes a first engagement member 72 arranged on the inner side member 46 and a complimentary second engagement member 74 arranged on the extension portion 34 of the picture carrier portion 6.

The second engagement member 74 is arranged as a through-hole aperture 76 through the wall of the extension portion 34, which is reinforced around a rim thereof. The first engagement member 74 is arrange as an extension 78 and a hooking tip 80. A length of the extension 78 is matched to a depth of the aperture 76 so that when inserted into the aperture 76 the hooking tip 80 can latch on to the rim of the aperture 76.

For the left and right side longitudinal frame members, the connection system 70 is distributed as two portions both equally spaced from a longitudinal centre of the frame members. For the top and bottom lateral frame members, the connection system 70 is arranged as a single central portion.

In variant embedment's, which are not illustrated: alternative connection systems are implemented, including as a non-locking interference fit; the aperture can be arranged on the inner side member and the extension and a hooking tip arranged on the extension portion; the connection system can be distributed as more portions or only as a single portion.

[Hinged Connection]

Figure 11:
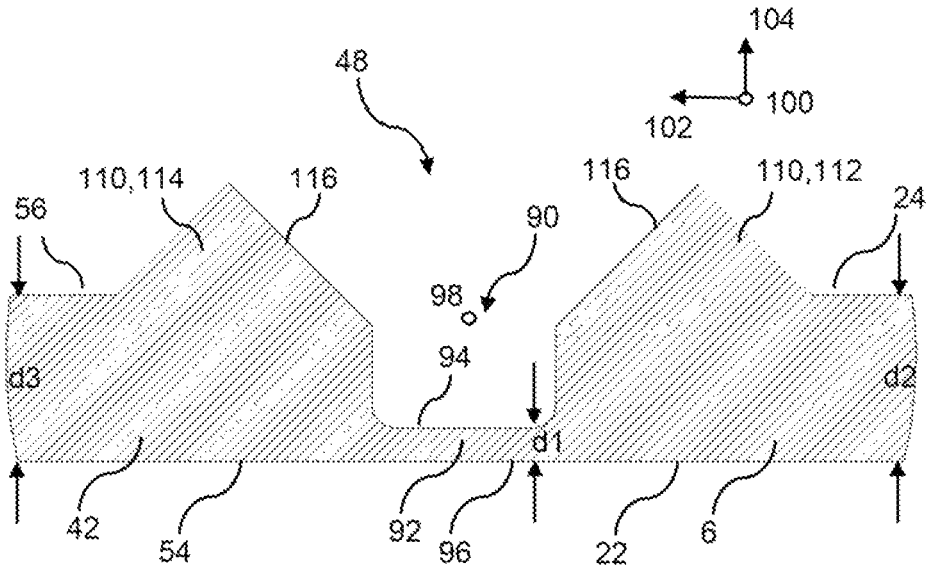
FIG. 11 is a side cross-sectional view showing a hinge connection of the picture frame of FIG. 1, which is arranged in an unassembled configuration.

Referring to FIG. 11 the first hinged connection 48 is arranged in the unassembled position, in which the outer side member 42 and picture carrier portion 6 are arranged in the same longitudinal 100 and lateral 102 extending plane.

Figure 12:
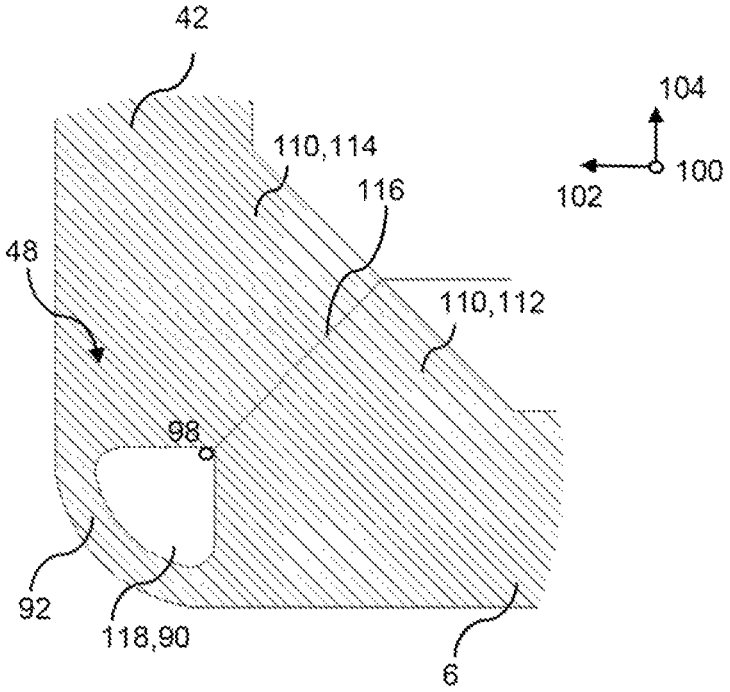
FIG. 12 is a side cross-sectional view showing a hinge connection of the picture frame of FIG. 1, which is arranged in an assembled configuration.

Referring to FIG. 12 the first hinged connection 48 is arranged in the assembled position, in which the outer side member 42 is rotated through 90 degrees such that it is arranged in a longitudinal 100 and depth 104 extending plane and picture carrier portion 6 remains in the longitudinal 100 and lateral 102 extending plane.

In the assembled position (FIG. 11) the first hinge connection 48 includes a cut-out portion 90 that extends from the back surfaces 56, 24 of the respective outer side member 42 and picture carrier portion 6 in the depth direction 104 to define a hinge member 92.

The cut-out portion 90 has a flat base that defines a back face 94 of the hinge member 92, and opposed front face 96 of the hinge member 92 is formed of the front faces 54, 22 of the respective outer side member 42 and picture carrier portion 6. The hinge member 92 is rectangular in shape.

In the assembled position (FIG. 12) the hinge member 92 curves around a hinge axis 98, which extends in the longitudinal direction 100. The hinge member 92 is curved with parallel tracked edges defined by the front face 96 and back face 94.

Although the first hinge connection 48 is described, it will be appreciated that the same configuration can be applied to the second hinge connection 50 and/or the third hinge connection 52.

A thickness d1 of the hinge member 92 in the depth direction is less than 20% or 10% of a thickness d2, d3 of the adjoining outer side member 42 and portion of the picture carrier portion 6 (not including the engagement portions as will be discussed).

In variant embodiments, which are not illustrated: the cut-out may have other shapes, including V-shaped, and; the hinge member may have other shapes including tapered.

[First Engagement System]

Referring to FIGS. 11 and 12, the first hinge connection 48 comprises a first engagement system 110 that is engaged to define in the assembled position (FIG. 12) a terminal hinge position, in which the outer side member 42 and picture carrier member 6 are at 90 degrees to each other. The first engagement system 110 is arranged as a first extension 112 arranged on the outer side member 40 and a second extension 114 arranged on the picture carrier portion 6. The first extension 112 and second extension 114 are arranged proximal sidewalls of the cut-out portion 90, such that they protrude directly therefrom.

In the unassembled position (FIG. 11) the extensions 112, 114 extend in the depth direction 104. In the assembled position (FIG. 12) the first extension 112 extends in the counter lateral direction 102, and the second extension 114 remains in the same position, such that the extensions 112, 114 are perpendicular to each other. An engagement surface 116 of the extensions 112 and 114 is inclined at 45 degrees to the lateral direction 102, such that the engagement members 112, 114 are brought into direct and full (e.g. with no voids therebetween) engagement with each other as the first hinge connection 48 is rotated about the hinge axis 98.

The first and second extensions 112, 114 are arranged so that load is transmitted through them rather than the comparatively weaker hinge member 92, which acts as a locator and cover for said extensions.

In the assembled position (FIG. 12) the first engagement system 110 and cut-out portion 90 define a void 118, which is bounded at one end by the hinge member 92 and at another end by the first engagement system 110. The void provides a region that the frame member 92 can curve unto uninhibited.

In variant embodiments, which are not illustrated: the first engagement system defines a terminal hinge position in which the outer side member and picture carrier member are at an angle other than 90 degrees to each other, e.g. within plus or minus 5 or 10 degrees from 90; the engage members may be alternatively profiled, including with alternatively angled or curved engagement surfaces.

Although the first hinge connection 48 is described, it will be appreciated that the same configuration can be applied to the second hinge connection 50 and/or the third hinge connection 52. Moreover, whilst a representative cross-section is shown, the described features of the first hinge connection may extend the entire length of the relevant frame member or may be distributed as discrete sections.

[Second Engagement System]

Referring to FIGS. 1-4, a second engagement system 120 is associated with the first hinge connection 48. The second engagement system 120 is engaged to define a terminal hinge position, which is the same as the terminal hinge position as defined by the first engagement system 110, i.e. with the outer side member 42 and the picture carrier portion 6 arranged at 90 degrees to each other.

Referring to FIGS. 1 and 2, in the unassembled position the second engagement system 120 is arranged distal the first hinge connection 48, and comprises a first engagement member arranged as an extension 122 that extends perpendicular to the back face 56 of the outer side member 42 and second engagement member arranged as an outer wall 124 of the extension portion 34 of the picture carrier portion 6. In the partially assembled position (FIG. 3, 4) the extension 122 is brought into engagement with the outer wall 124.

Figure 3:
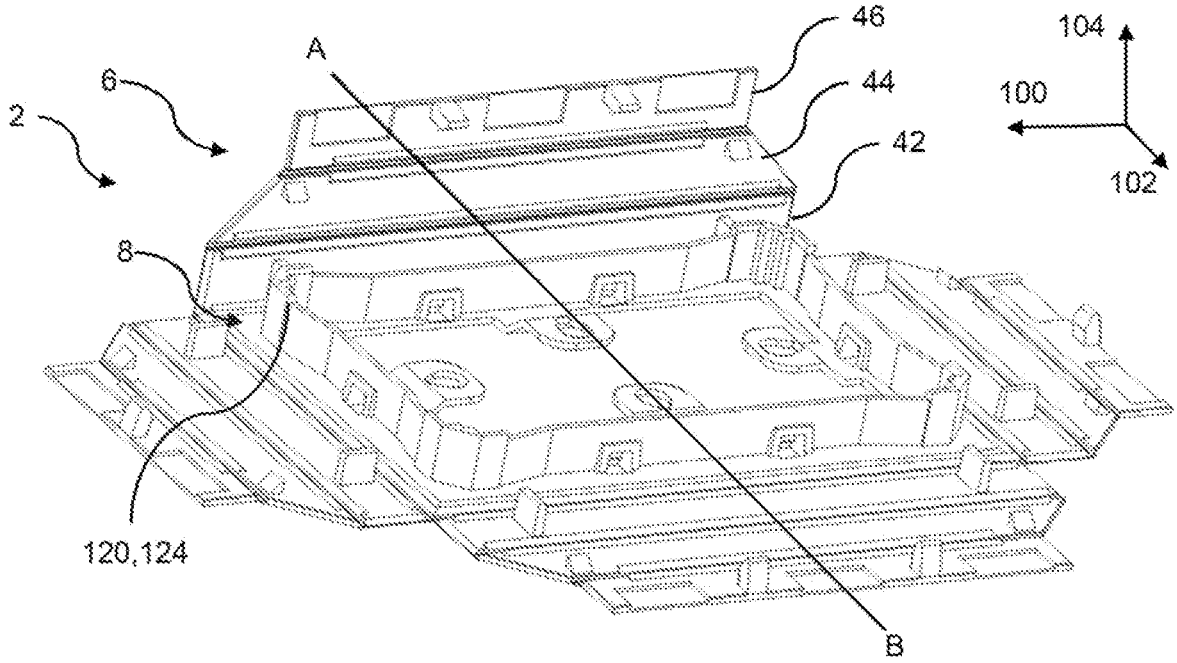
FIG. 3 is a back perspective view showing the picture frame of FIG. 1, which is arranged in a partially assembled configuration.
Figure 4:
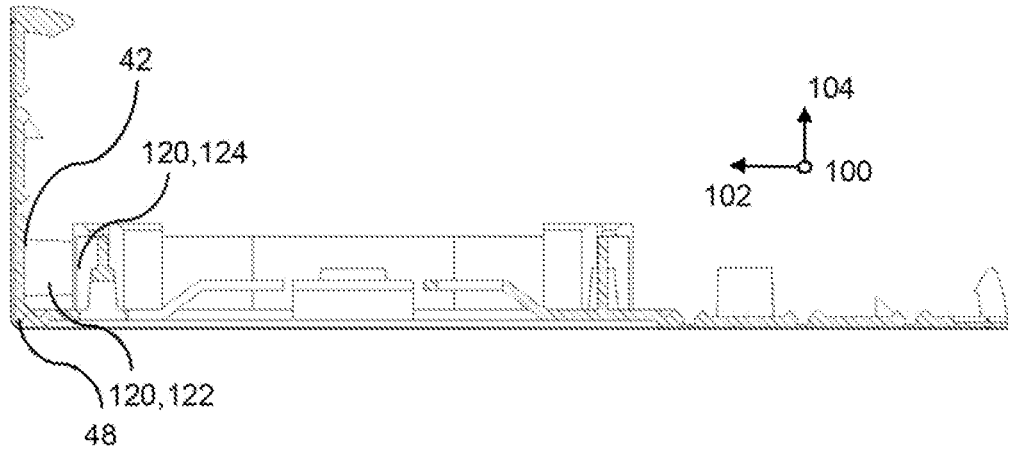
FIG. 4 is a side cross-section view through line AB of FIG. 3.

The extensions 122 are arranged with a tip to extend aligned to the outer side member 42, such that the tip progressively engages the outer wall 124 as the outer side member 42 is moved to the partially assembled position (from the position of FIGS. 1, 2 to the position of FIGS. 3, 4).

The second engagement system 120 is distributed as two portions, i.e. as two extensions 122 and complimentary wall outer wall portions, which are arranged proximal the ends of the outer side member 40.

In a similar manner, a second engagement system 120 is provided for the second hinge connection 50 by means of a rim of the extension portion 34 of the picture carrier portion 6 that engages with a back face 60 of the back member 44.

In variant embodiments, which are not illustrated: a terminal hinge position defined by the second engagement system may be different to that defined by the first engagement system e.g. so that one engages before the other, as an example the second engagement system may engage first to reduce pressure on the hinge connection caused by the engagement of the first engagement system; the first and second engagement members may be alternatively profiled; the second engagement system may be distributed as a single or other number of portions, and; the second engagement system may be omitted.

[Third Engagement System]

Figure 5:
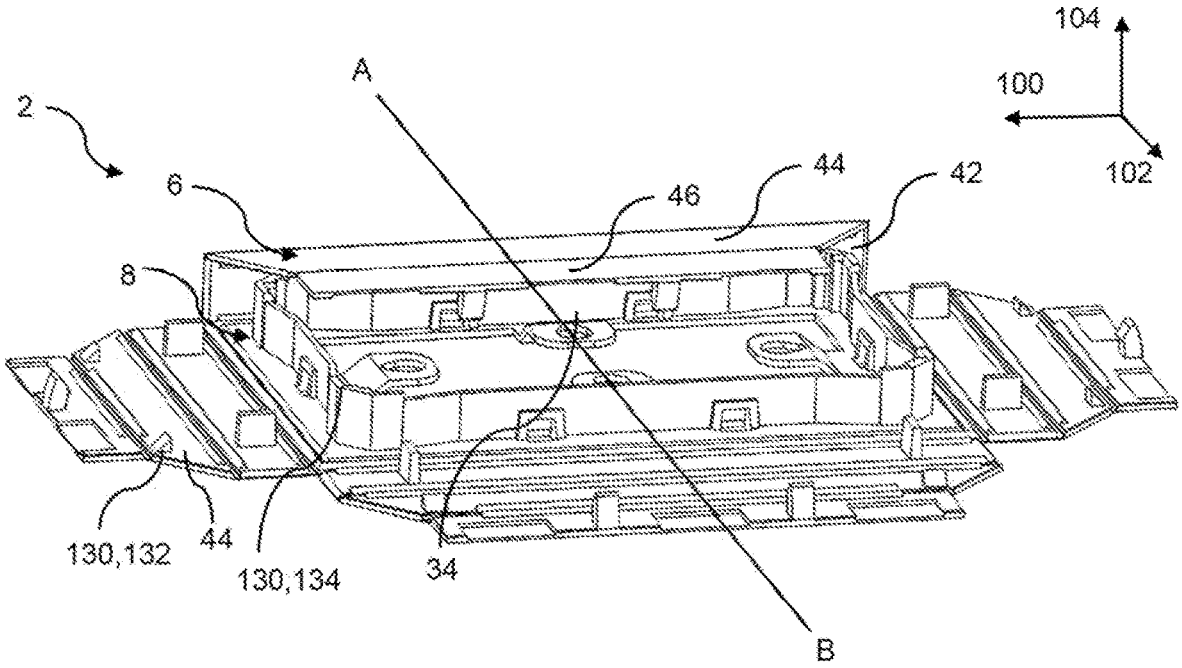
FIG. 5 is a back perspective view showing the picture frame of FIG. 1, which is arranged in a partially assembled configuration.
Figure 6:
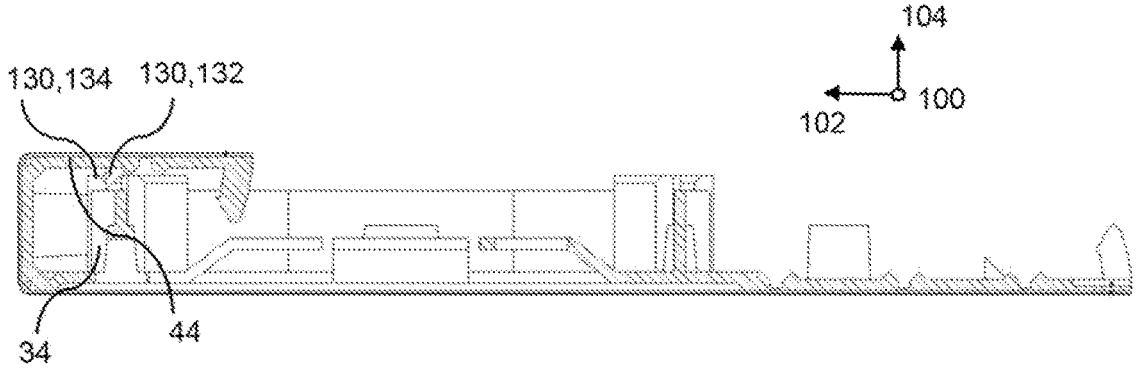
FIG. 6 is a side cross-section view through line AB of FIG. 5.

Referring to FIGS. 1, 2 and 5, 6, a third engagement system 130 is arranged to engage when the second engagement system is correspondingly engaged. Referring to FIG. 6, the second engagement system 120 resists movement of the outer side member 40 in the counter lateral direction 102 and the third engagement system 130 resists movement of the outer side member 40 in the lateral direction 102.

The third engagement system 130 is arranged as a first engagement member arranged as an extension 132 that extends perpendicular to the back face 60 of the back member 44 and a second engagement member arranged as an inner wall 134 of the extension portion 34 of the picture carrier portion 6. In the partially assembled position (FIG. 5, 6) the extension 132 is brought into engagement with the inner wall 134.

Referring to FIGS. 1 and 5, the extension portion 34 extends in a lateral direction 102 outwardly from a portion comprising the second engagement member 74 of the connection system 70 to accommodate the third engagement system 130 on the same extension portion 34.

As discussed for the second engagement system 120, the third engagement system 130 is engaged to define a terminal hinge position with the outer side member 40 and the picture carrier portion 6 arranged at 90 degrees to each other.

In variant embodiments, which are not illustrated: a terminal hinge position defined by the third engagement system may be different to that defined by the first and/or engagement system e.g. so that one engages before the other; the first and second engagement members may be alternatively profiled; the third engagement system may be distributed as a single or other number of portions, and; the third engagement system may be omitted.

[Picture Member]

Referring to FIG. 13, in the unassembled position, the picture member 4 includes a front face 140 and a back face 142. Cut-out regions 144 define a centre portion 146 and an outer side portion 148 a back portion 150 and an inner side portion 152.

When assembled on the picture frame 2 (FIGS. 9 and 10), the back face 142 abuts the picture frame 2 and the front face 140 faces away from the picture frame 2 to display a picture. The centre portion 146 overlaps the front face 22 of the body 20 of the picture carrier portion 6. The outer side portion 148 overlaps the outer side member 42. The back portion 150 overlaps the back member 44. The inner side portion 152 overlaps the inner side member 46.

[Fixing System]

Referring to FIGS. 1 and 9, the inner side member 46 includes reduced thickness portions 154 to aid insertion of a fixing member, arranged as a staple 156 therethrough to fix the inner side portion 152 of the picture member 2 to the front face 62 of the inner side member 46. The reduced thickness portions are arranged on either side of the first engagement member 72 of the connection system 70.

By fixing the picture member 2 to the front face 62 of the inner side member 46 it can wrap entirely around the visible portion of the frame portion 2, which is both aesthetically pleasing and enables a precise amount of tension to be applicated in the assembled position.

In variant embodiments, which are not illustrated: the reduced thickness portions are alternatively arranged or are omitted, and; alternative fixing member may be used, including an adhesive.

[Stand Connection]

Figure 14:
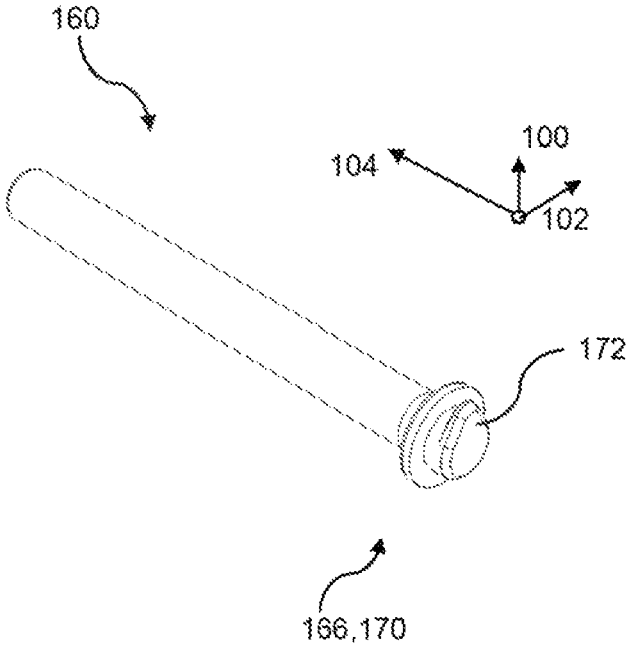
FIG. 14 is a perspective view of a stand for the picture frame of FIG. 1.

Referring to FIGS. 1 and 14, a stand portion 160, is connectable to the picture frame 2 via an engagement system 162. The engagement system 162 includes a first engagement member 164 arranged as an aperture 168 in the picture frame 2 and a second engagement member 166 arranged as a complimentary head 170 of the stand portion 160.

The head 170 is insertable in to the aperture 168 in an open position and is rotatable to a locked position where it is not extractable from the aperture 168. This is achieved by the head having a key extension 172 that corresponds in shape to the aperture 168 such that it can project through the aperture in the open position but which abuts against a proximal inner wall of the aperture 168 when rotated from the open position to the locked position.

In variant embodiments, which are not illustrated: the engagement system is alternatively implemented including as an interference fit.

[Method of Assembly]

Step 1: Referring to FIGS. 1 and 13, the picture member 4 is arranged over the picture frame 2, with the picture carrier portion 6 and a frame portion 8 aligned in an in-plane direction in the unassembled position.

Step 2: With the back face 142 of the picture member 4 abutting the picture frame 2, the staples 156 are inserted though the reduced thickness portions 154 of the inner side member 46.

Step 3: The picture frame 2 is then moved from the unassembled position (FIGS. 1 and 2) to the partially assembled position (FIGS. 3 and 4) wherein the outer side member 42 is rotated at the first hinge connection 48 through 90 degrees to the picture carrier portion 6 to engage the first engagement system 110 of the first hinge connection 48 and the second engagement system 120.

Step 4: The picture frame 2 is then moved from the partially unassembled position (FIGS. 3 and 4) to the partially assembled position (FIGS. 5 and 6) wherein the back member 44 is rotated at the second hinge connection 50 through 90 degrees to the outer side member 42 to engage the first engagement system 110 of the second hinge connection 50 and the second engagement system 120 and third engagement system 130.

Step 5: The picture frame 2 is then moved from the partially unassembled position (FIGS. 5 and 6) to the assembled position (FIGS. 7-10) wherein the inner side member 46 is rotated at the third hinge connection 52 through 90 degrees to the back member 44 to engage the first engagement system first 110 of the third hinge connection 52 and the connection system 70 to lock the frame members 40 in position.

As used in this specification, any formulation used of the style "at least one of A, B or C", and the formulation "at least one of A, B and C" use a disjunctive "or" and a disjunctive "and" such that those formulations comprise any and all joint and several permutations of A, B, C, that is, A alone, B alone, C alone, A and B in any order, A and C in any order, B and C in any order and A, B, C in any order. There may be more or less than three features used in such formulations.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

Unless otherwise explicitly stated as incompatible, or the physics or otherwise of the embodiments, example or claims prevent such a combination, the features of the foregoing embodiments and examples, and of the following claims may be integrated together in any suitable arrangement, especially ones where there is a beneficial effect in doing so. This is not limited to only any specified benefit, and instead may arise from an "ex post facto" benefit. This is to say that the combination of features is not limited by the described forms, particularly the form (e.g. numbering) of the example(s), embodiment(s), or dependency of the claim(s). Moreover, this also applies to the phrase "in one embodiment", "according to an embodiment" and the like, which are merely a stylistic form of wording and are not to be construed as limiting the following features to a separate embodiment to all other instances of the same or similar wording. This is to say, a reference to 'an', 'one' or 'some' embodiment(s) may be a reference to any one or more, and/or all embodiments, or combination(s) thereof, disclosed. Also, similarly, the reference to "the" embodiment may not be limited to the immediately preceding embodiment.

As used herein, any machine executable instructions, or compute readable media, may carry out a disclosed method, and may therefore be used synonymously with the term method, or each other.

The foregoing description of one or more implementations provides illustration and description, but is not intended to be exhaustive or to limit the scope of the invention to the precise form disclosed. Modifications and variations are possible in light of the above teachings or may be acquired from practice of various implementations of the present disclosure.

LIST OF REFERENCES

- 2 Picture frame
  - 10 Front face (assembled)
  - 12 Back face (assembled)
  - 14 Outer side face (assembled)
  - 16 Inner side face (assembled)
  - 6 Picture carrier portion
    - 20 Body
      - 22 Front face
        - Recess
      - 24 Back face
      - 26 Aperture
      - 28 Flange
        - 30 Inner edge
        - 32 Outer edge
      - 34 Extension portion
  - 8 Frame portion
    - 40 Frame members
      - 42 Outer side member
        - 54 Front face
        - 56 Back face
      - 44 Back member
        - 58 Front face
        - 60 Back face
      - 46 Inner side member
        - 62 Front face
        - 64 Back face
        - 66 Tip
      - 48 First hinge connection
        - 90 Cut-out portion
        - 92 Hinge member
        - 94 Back face
        - 96 Front face
        - 98 Hinge axis
        - 110 First engagement system
        - 112 First extension
        - 116 Engagement surface
        - 114 Second extension
        - 116 Engagement surface
        - 118 Void
        - 120 Second extension system
        - 122 Extension (first engagement member)
        - 124 Outer wall (second engagement member)
        - 130 Third extension system
        - 132 Extension (first engagement member)
        - 134 Inner wall (second engagement member)
      - 50 Second hinge connection
      - 52 Third hinge connection
  - 70 Connection system
    - 72 First engagement member (latch)
      - 78 Extension
      - 80 Hooking tip
    - 74 Second engagement member (catch)
      - 76 Aperture
  - 4 Picture member
    - 140 Front face
    - 142 Back face
    - 144 Cut-out regions
    - 146 Centre portion
    - 148 Outer side portion
    - 150 Back portion
    - 152 Inner side portion
  - 160 Stand portion
    - 162 Engagement system
      - 164 First engagement member
        - 168 Aperture
      - 166 Second engagement member
        - 170 Head
        - 172 Keyed extension
  - 156 Fixing member (staple)

The invention claimed is:

1. A picture frame comprising a picture carrier portion and a frame portion, the frame portion comprising frame members with: an outer side member hingedly connected at a first hinge connection to the picture carrier portion; a back member hingedly connected at a second hinge connection to the outer side member, and an inner side member hingedly connected at a third hinge connection to the back member, wherein in an assembled position: the outer side member forms an outer side of the frame; the back member forms a back of the frame, and; the inner side member forms an inner side of the frame, wherein a connection system is arranged as a locking connection movable from an unlocked position to a locked position to lock the inner side member directly to the picture carrier portion, the connection system including a first engagement member arranged on the inner side and a complimentary second engagement member arranged on the picture carrier portion.

2. The picture frame of claim 1, wherein the first engagement member includes one of a hook shaped extension or a complimentary aperture, and the second engagement member includes the other of a hook shaped extension or a complimentary aperture.

3. The picture frame of claim 1, wherein the second engagement member is arranged on an extension portion that extends from a body of the picture carrier portion.

4. The picture frame of claim 3, wherein the extension portion extends in a lateral or longitudinal direction outwardly towards the outer side member from a portion comprising the second engagement member of the connection system to accommodate the third engagement system.

5. The picture frame of claim 1, wherein a second engagement system is operatively associated with at least one of the hinge connections, the second engagement system engaged to define a terminal hinge position, in which adjoining frame members or the adjoining outer side member and the picture carrier portion are perpendicular to each other, wherein the engagement system is arranged distal said hinge connection.

6. The picture frame of claim 5, wherein the second engagement system is arranged to define a terminal hinge position of the first hinged connection, and a third engagement system is arranged with a first engagement member on the back member to engage with a second engagement member on the picture carrier portion to maintain the outer side member in the terminal hinge position.

7. The picture frame of claim 1, wherein in the assembled position a rim of the inner side member engages a back surface of a body of the picture carrier portion.

8. The picture frame of claim 1, wherein in the unassembled position, the frame members are arranged in a longitudinal and lateral plane of the picture carrier portion with the inner side member having a front face to receive the picture member.

9. The picture frame of claim 8, wherein the inner side member includes reduced thickness portions to aid insertion of a fixing member therethrough to fix the picture member to the inner side member.

10. The picture frame of claim 1, wherein one or more of said hinged connections is arranged with a cut-out portion that in an unassembled position, in which the frame members are arranged in a lateral and longitudinal plane of the picture carrier portion, includes a flat base to define a hinge member, wherein in the assembled position the hinge member curves around a hinge axis.

11. The picture frame of claim 10, wherein the hinge member is formed integrally with the adjoining frame members and/or an adjoining frame member and picture carrier portion, and wherein a thickness of the hinge member is less than 20% of a thickness of the adjoining frame members and/or an adjoining frame member and picture carrier portion.

12. The picture frame of claim 1, wherein at least one of the hinge connections comprises a first engagement system that is engaged to define a terminal hinge position, in which the adjoining frame members or an adjoining frame member and picture carrier portion are perpendicular to each other.

13. The picture frame of claim 12, wherein the first engagement system is arranged as one or more extension that extends outwardly from adjoining frame members or an adjoining frame member and picture carrier portion.

14. A picture frame of claim 1 and a corresponding picture member.

15. The picture frame and picture member of claim 14, arranged in the assembled position, with the picture member fixed to the picture carrier portion.

16. A method of assembling a picture frame comprising:

with a frame portion comprising frame members with: an outer side member hingedly connected at a first hinge connection to a picture carrier portion; a back member hingedly connected at a second hinge connection to the outer side member, and an inner side member hingedly connected at a third hinge connection to the back member, connecting a picture member to the picture carrier portion;

hinging the hinge connections to connect directly with a locking connection the inner side member to the picture carrier member, with a first engagement member arranged on the inner side member and a complimentary second engagement member arranged on the picture carrier portion.

17. The method of claim 16 comprising connecting the picture member to the inner side member prior to hinging said hinge connections.

18. The method of claim 16 comprising:

hinging about a hinge axis a hinge member of the hinged connections of the frame portion that is connected to the picture carrier portion, wherein the hinged connections include a cut-out portion with a flat base to define said hinge member.

19. A picture frame comprising a picture carrier portion and a frame portion, the frame portion comprising frame members with: an outer side member hingedly connected at a first hinge connection to the picture carrier portion; a back member hingedly connected at a second hinge connection to the outer side member, and an inner side member hingedly connected at a third hinge connection to the back member, wherein in an assembled position: the outer side member forms an outer side of the frame; the back member forms a back of the frame, and; the inner side member forms an inner side of the frame, wherein a connection system is arranged to lock the inner side member to the picture carrier portion wherein a second engagement system is operatively associated with at least one of the hinge connections, the second engagement system being arranged to define a terminal hinge position of the first hinged connection, in which adjoining frame members or the adjoining outer side member and the picture carrier portion are perpendicular to each other, and the second engagement system being arranged distal said hinge connection, and wherein a third engagement system is arranged with a first engagement member on the back member to engage with a second engagement member on the picture carrier portion to maintain the outer side member in the terminal hinge position.

20. The picture frame of claim 19, wherein the third engagement system is arranged with the second engagement member on an extension portion that extends from a body of the picture carrier portion.

* * * * *